United States Patent [19]

Conigliaro et al.

[11] Patent Number: 4,682,740

[45] Date of Patent: Jul. 28, 1987

[54] SHREDDER FOR LEAVES AND OTHER LIKE YARD AND GARDEN REFUSE

[75] Inventors: Anthony Conigliaro, Sherborn; Arthur St. Hilaire, Reading; Sal G. De Yoreo, Andover, all of Mass.

[73] Assignee: Armatron International, Inc., Melrose, Mass.

[21] Appl. No.: 901,047

[22] Filed: Aug. 27, 1986

[51] Int. Cl.[4] ..... B02C 18/12

[52] U.S. Cl. ..... 241/282.1; 241/101.7

[58] Field of Search ..... 241/101.7, 194, 282.1, 241/89.1, 282.2, 89, 189 R

[56] References Cited

U.S. PATENT DOCUMENTS

| | | | |
|---|---|---|---|
| 1,634,026 | 6/1927 | Fritz | 241/89 X |
| 3,608,838 | 9/1971 | Lundin et al. | 241/101.7 X |
| 4,403,743 | 9/1983 | Ducasse | 241/282.2 X |
| 4,477,029 | 10/1984 | Green | 241/101.7 |
| 4,580,735 | 4/1986 | Lange | 241/101.7 |
| 4,593,863 | 6/1986 | Mordstein et al. | 241/101.7 X |

*Primary Examiner*—Mark Rosenbaum

*Attorney, Agent, or Firm*—Samuels, Gauthier

[57] ABSTRACT

A shredder has a container enclosing a chamber. A shredding mechanism is rotatably mounted in the chamber and is driven by an exteriorly located motor. A loading port is provided in the container through which the material to be shredded may be received in the chamber. The arrangement of the loading port in relation to the shredding mechanism is such that the thus received material will drop under the influence of gravity onto and be shredded by the shredding mechanism. The shredded material exits through a discharge port underlying the shredding mechanism.

9 Claims, 7 Drawing Figures

SHREDDER FOR LEAVES AND OTHER LIKE YARD AND GARDEN REFUSE

BACKGROUND OF THE INVENTION

1. Field of the Invention

This invention relates to shredders, and is concerned in particular with an improved shredder for rapidly, efficiently and safely breaking down leaves and other like yard and garden refuse.

2. Description of the Prior Art

In some of the known shredders, the leaves are drawn up by a vacuum air stream and passed over the rotating blades of fans, impellers or the like. If the leaves are relatively dry, they will flow through the shredder in a generally satisfactory manner. However, if the leaves are wet, as is often the case, they will adhere to internal guide surfaces, causing frequent clogging of the shredder. In other known shredders, the blades or the like are susceptible to being damaged by stones, etc. which are received along with the material to be shredded.

A primary objective of the present invention is the provision of a shredder which relies on gravity feed rather than an air stream to bring the materials to be shredded into contact with the shredding mechanism. This substantially minimizes and in most cases completely eliminates any clogging problems, regardless of the moisture content of the materials being shredded.

Another objective of the present invention is to provide a shredder mechanism which is not susceptible to damage by ingestion of stones and other like high density objects.

Still another objective of the present invention is the provision of a shredder having control means for varying the particle size of the shredded material, thereby making it possible for the user to control the density of the shredded material to suit a wide variety of end uses, e.g., more compact disposal, garden mulch, etc.

SUMMARY OF THE INVENTION

A shredder in accordance with the present invention has a container enclosing a chamber containing a shredding mechanism. Preferably, the shredding mechanism constitutes a rotatably driven head with one or more yieldable elements extending longitudinally and radially therefrom. The container has a loading port through which the material to be shredded is received for deposit under the influence of gravity directly onto the shredding mechanism. After being shredded, the material exits the chamber through a discharge port underlying the shredding mechanism. An adjustable gate mechanism at the discharge port provides a means of retarding the passage of the material therethrough, thereby prolonging the exposure of the material to the shredding mechanism to produce smaller exiting particles.

DETAILED DESCRIPTION OF PREFERRED EMBODIMENTS

Figure 1:
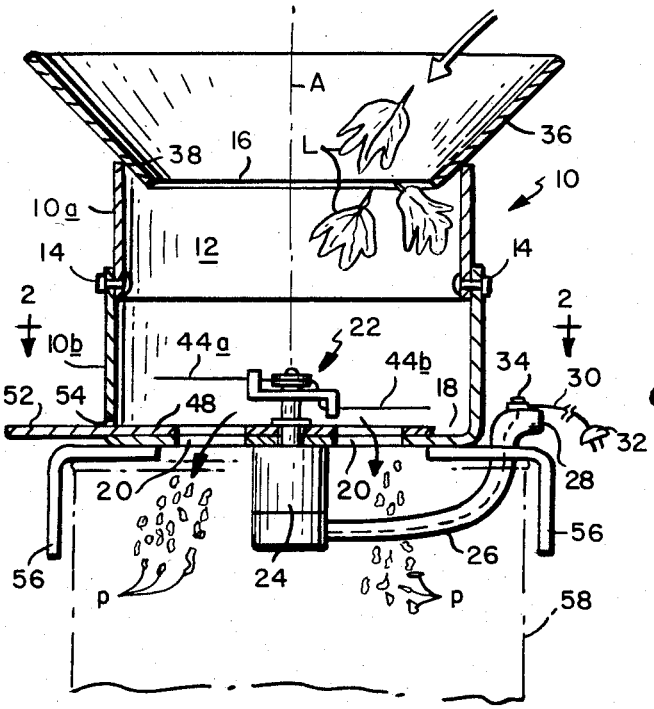
FIG. 1 is a vertical cross sectional view taken through a shredder in accordance with the present invention.
Figure 2:
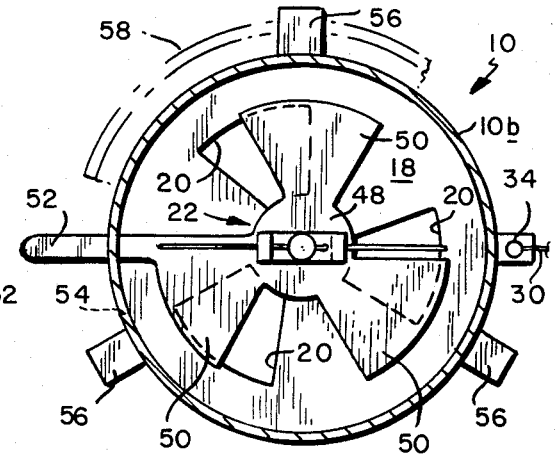
FIG. 2 is a horizontal sectional view taken along line 2—2 of FIG. 1.

Referring initially to FIGS. 1 and 2, a shredder is shown comprising a container 10 enclosing a chamber 12. The container may be of multiple part construction, constituting for example a cylindrical upper side wall 10*a* received in and connected by means of bolts 14 or the like to a cylindrical lower side wall 10*b*. The upper end of side wall 10*a* is open to define a loading port 16, and the lower end of the lower side wall 10*b* is closed by a bottom wall 18 having a discharge port therein defined by a plurality of openings 20.

Preferably, the loading port 16 and the openings 20 constituting the discharge port are arranged concentrically with respect to a common vertical axis "A".

A shredding mechanism generally indicated at 22 is mounted within the chamber 12 between the loading and discharge ports for rotation about axis A. The shredding mechanism is rotatably driven by an electrically powered motor 24 arranged exteriorly of chamber 12 at a central location depending from the bottom container wall 18. The motor 24 is preferably provided with a duct 26 having a remote inlet.end 28 through which air is admitted to cool the motor. The same duct 26 can also accommodate an electrical power cord 30 leading to a plug 32 with an ON-OFF switch 34 interposed therebetween.

A truncated conical hopper 36 is preferably supported on the upper container wall 10*a*. The smaller end of the hopper is received in the loading port 16 and extends inwardly from the side wall 10*a* to define a circular downwardly sloping ledge 38.

Figure 3:
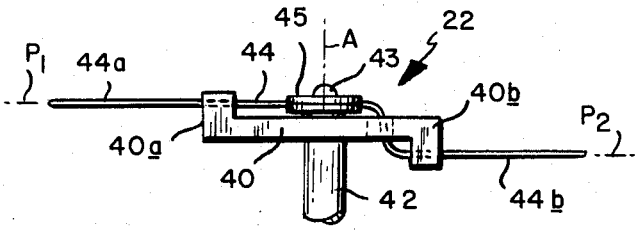
FIGS. 3 and 4 are enlarged side elevational and top plan views respectively of the shredding mechanism shown in FIGS. 1 and 2.
Figure 4:
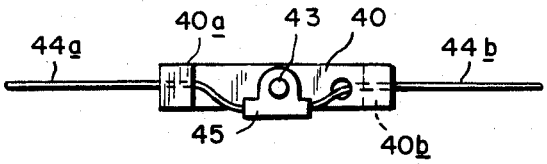

With reference to FIGS. 3 and 4, it will be seen that the shredding mechanism 22 comprises a head 40 fixed to the output shaft 42 of motor 24. The head is respectively provided at its opposite ends with upstanding and depending legs 40*a* and 40*b*. A flexible shredder element 44 is threaded through openings in the legs 40*a*, 40*b*, and the ends 44*a*, 44*b* of the element extend longitudinally and radially from the head 40. An intermediate portion of the element 44 includes a ring-type connector 45 surrounding a pin 43 on the end of the shaft 42. The ends 44*a*, 44*b* are thus located in vertically spaced planes $P_1$,$P_2$.

Figure 5:
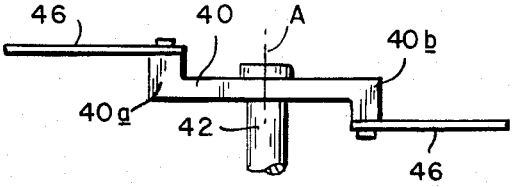
FIGS. 5 and 6 are enlarged side elevational and top plan views respectively depicting an alternate embodiment of a shredding mechanism.
Figure 6:
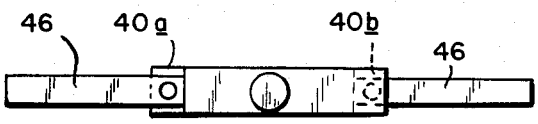

FIGS. 5 and 6 depict an alternate embodiment of a shredding mechanism wherein the shredder elements constitute relatively rigid flat members 46 pivotally connected to and freely swingable on the legs 40*a*, 40*b*.

Figure 7:
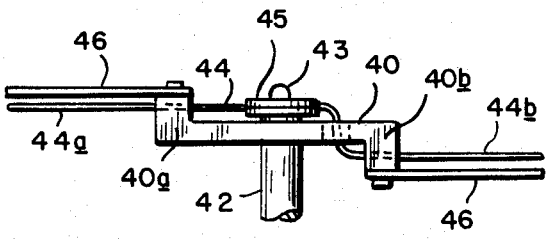
FIG. 7 is an enlarged side elevational view of still another embodiment of a shredding mechanism.

FIG. 7 depicts still another embodiment of a shredding mechanism combining the features shown in FIGS. 3–6, i.e., employing a flexible shredder element 44 together with flat members 46.

A gate member 48 is mounted between the shredding mechanism 22 and the bottom container wall 18 for rotation about axis A. The gate member has radially extending panels 50. A handle 52 on one of the panels protrudes exteriorly of the container 10 through a narrow slot 54 in the lower container side wall 10*b*. By rotatably adjusting the gate 48, the panels 50 can be positioned between fully "open" positions located between the openings 20, and fully "shut" positions completely closing off the openings 20. As shown in FIG. 2, the panels 50 are adjusted to partially occlude the openings 20.

Legs 56 are provided on the underside of the container 10. The legs can be dimensioned and arranged to mount the container on a trash barrel 58 or other like receptacle. Alternatively, the legs can be made longer to support the container on the ground in a free standing position.

The shredder operates in the following manner. The motor 24 is first energized to rotatably drive the shredding mechanism at a relatively high speed of about 15,000 RPM. The material to be shredded, e.g., leaves "L", is then manually dumped into the hopper 36. The leaves drop under the influence of gravity through the loading port 16 directly onto the rotatably driven shredding mechanism 22. The radially extending shredder elements 44 and/or 46 break the leaves up into smaller particles "p" which then drop through the openings 20.

Since the leaves are dumped directly onto the shredding mechanism, there is no opportunity for adherence to internal guide ducts, passageways or the like. Thus, the shredding process is not hampered by moisture content. Rather, an elevated moisture content may actually increase shredding efficiency.

By arranging the shredder elements in multiple planes $P_1$,$P_2$, greater shredding efficiency is achieved. The adjustment of the gate 48 controls the outgoing particle size. For example, in the fully open position, the particles p will be larger due to the fact that they readily drop through the openings 20 with only minimum exposure to the shredding mechanism 22. However, as the gate 48 is gradually closed and the panels 50 reduce the size of the openings 20, the exposure of the material to the shredding mechanism will be prolonged, resulting in the production of smaller or finer particle sizes.

Any stones or the like which happen to be dumped into the container along with the material to be shredded will either pass directly through the openings 20, or if they are contacted by the shredder elements 44, and/or 46 they will be thrown against the container side and kept there until the shredder is shut down and they are removed. The shredder elements are yieldable and hence will not be damaged by contact with stones or the like.

The circular ledge 38 prevents material from climbing the container walls and escaping from the chamber 12.

In light of the foregoing, it will now be appreciated by those skilled in the art that changes and modifications may be made to the embodiments herein described and illustrated. For example, under certain conditions, it may be desirable to employ one or more shredder elements arranged in a single plane. Multiple shredding mechanisms also may be employed with shredder elements rotating on overlapping but vertically staggered paths. Different styled louvers or adjustable openings can be employed in place of the rotatable gate.

It is my intention to cover these and any other changes or modifications which do not depart from the spirit and scope of the invention as defined by the following claims.

I claim:

1. A shredder comprising:

a container;

a shredding mechanism including a head mounted within said container for rotation about a vertical axis, said head having flexible elements extending radially outwardly therefrom;

motor means for rotatably driving said head to thereby cause said flexible elements to follow a rotational path;

said container being open at the top to define a loading port through which material may be received for shredding by said shredding mechanism, said loading port being arranged concentric to said vertical axis at a location directly overlying substantially the entire rotational path of said flexible elements; and said container being closed at the bottom by a bottom wall having a discharge port therein through which the thus shredded material may be removed from said container, said discharge port being defined by a plurality of openings directly underlying the rotational path of said flexible elements and angularly spaced one from the other around said vertical axis.

2. The shredder of claim 1 further comprising control means for retarding the exit of shredded material through said discharge port, thereby prolonging the exposure of said material to said shredding mechanism.

3. The shredder mechanism of claim 2 wherein said control means comprises a gate movable in relation to said openings for adjusting the sizes thereof.

4. The shredder of claim 1 wherein a plurality of said flexible elements are arranged in vertically spaced planes.

5. The shredder of claim 1 wherein said container is comprised of a vertically disposed cylindrical side wall open at the top to form said loading port and closed at the bottom by said bottom wall.

6. The shredder of claim 5 further comprising a truncated conical hopper having its smaller end received in said loading port and its enlarged end spaced vertically thereabove.

7. The shredder of claim 6 wherein the smaller end of said hopper extends inwardly of said cylindrical side wall to define a circular ledge.

8. The shredder of claim 1 wherein said motor means is arranged exteriorly of said container and beneath said bottom wall.

9. A shredder comprising in combination:

a container having a vertically disposed cylindrical side wall open at the top to form a loading port and closed at the bottom by a bottom wall;

a truncated conical hopper having its smaller end received in said loading port and its enlarged end spaced vertically thereabove, the smaller end of said hopper extending inwardly of said cylindrical wall to define a circular ledge;

a shredding mechanism including a head mounted within said container for rotation about a vertical axis which is coincident with the axis of said container, said head having a plurality of flexible elements extending radially outwardly therefrom in vertically spaced planes;

motor means for rotatably driving said head to thereby cause said flexible elements to follow a rotational path, said motor means being located exteriorly of said container beneath said bottom wall;

said loading port and said hopper being arranged concentric to said vertical axis at a location directly overlying substantially the entire rotational path of said flexible elements, whereupon material received through said hopper and said loading port will drop under the influence of gravity directly onto said shredding mechanism for shredding by said flexible elements;

said discharge port being defined by a plurality of openings directly underlying the rotational path of said flexible elements and through which the thus shredded material may be removed from said container, said openings being angularly spaced one from the other around said vertical axis; and control means for retarding the exit of shredded material through said openings to thereby prolong the exposure of said material to said shredding mechanism, said control means including a gate rotatable about said vertical axis and in relation to said bottom member for adjusting the size of said openings.

* * * * *